United States Patent [19]

Minasy et al.

[11] Patent Number: 4,684,930

[45] Date of Patent: Aug. 4, 1987

[54] METHOD AND APPARATUS FOR DEACTIVATING TARGETS USED IN ELECTROMAGNETIC TYPE ARTICLE SURVEILLANCE SYSTEMS

[75] Inventors: Arthur J. Minasy, Woodbury; Peter A. Pokalsky, East Meadow, both of N.Y.

[73] Assignee: Knogo Corporation, Hicksville, N.Y.

[21] Appl. No.: 840,904

[22] Filed: Mar. 18, 1986

[51] Int. Cl.[4] ..... G08B 13/24

[52] U.S. Cl. ..... 340/551; 335/284; 340/572

[58] Field of Search ..... 340/572, 551; 335/284

[56] References Cited

U.S. PATENT DOCUMENTS

| | | | |
|---|---|---|---|
| 3,665,449 | 5/1972 | Elder et al. | 340/572 |
| 3,747,086 | 7/1973 | Peterson | 340/572 |
| 3,820,103 | 6/1974 | Fearon | 340/572 |
| 3,820,104 | 6/1974 | Fearon | 340/572 |
| 4,075,618 | 2/1978 | Montean | 340/572 |
| 4,118,693 | 10/1978 | Novikoff | 340/572 |
| 4,326,198 | 4/1982 | Novikoff | 340/572 |
| 4,384,281 | 5/1983 | Cooper | 340/572 |
| 4,499,444 | 2/1985 | Heltemes et al. | 335/284 |
| 4,568,921 | 2/1986 | Pokalsky | 340/572 |

FOREIGN PATENT DOCUMENTS

| | | |
|---|---|---|
| 3014667 | 10/1981 | Fed. Rep. of Germany . |
| 763681 | 5/1934 | France . |

OTHER PUBLICATIONS

3M, "Plastiform ® Brand Magnetic Strip and Sheeting MGO 1016".

U.S. patent application Ser. No. 513,242, filed Jul. 13, 1983.

*Primary Examiner*—Glen R. Swann, III

*Attorney, Agent, or Firm*—Fitzpatrick, Cella, Harper & Scinto

[57] ABSTRACT

A deactivator for deactivating targets used in electromagnetic article surveillance systems comprises a solid element with a convexly curved outer surface, e.g., a cylinder and a plurality of permanent magnets which form a patter of variously directed magnetic fields is a plane adjacent the surface. The curved surface of the deactivator is rolled over a target to be deactivated. The magnets are also arranged in adjacent layers with the magnets of one layer extending in a different direction from the magnets of the other layer to form a composite magnetic pattern which is discontinuous in all directions.

16 Claims, 9 Drawing Figures

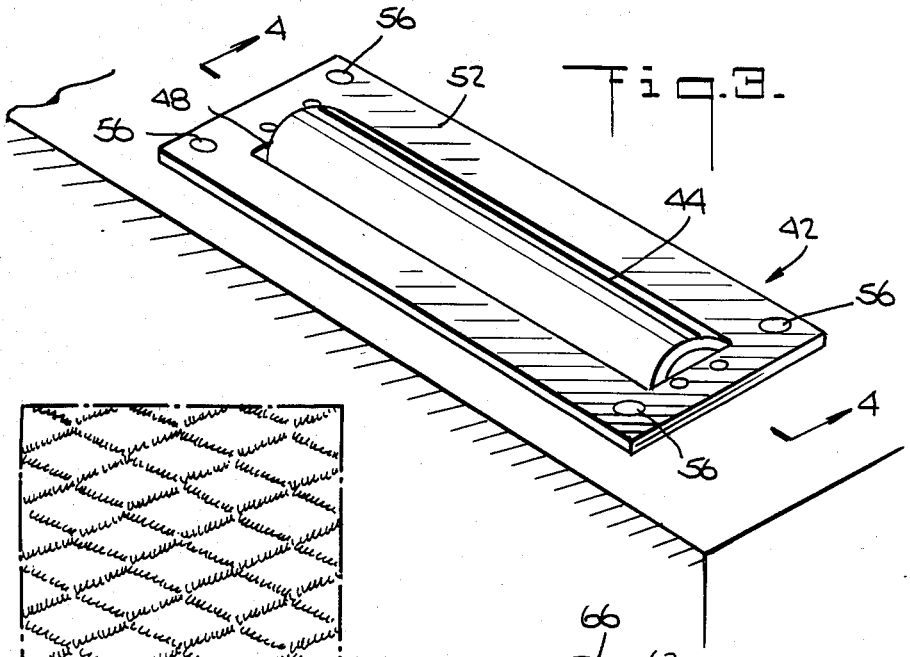
Fig. 3.
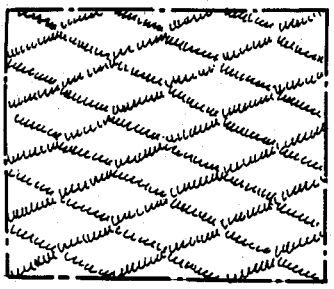
Fig. 4.
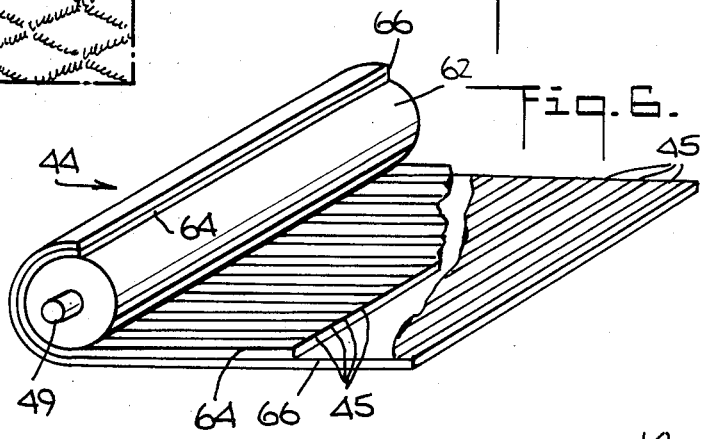
Fig. 6.
Fig. 5.
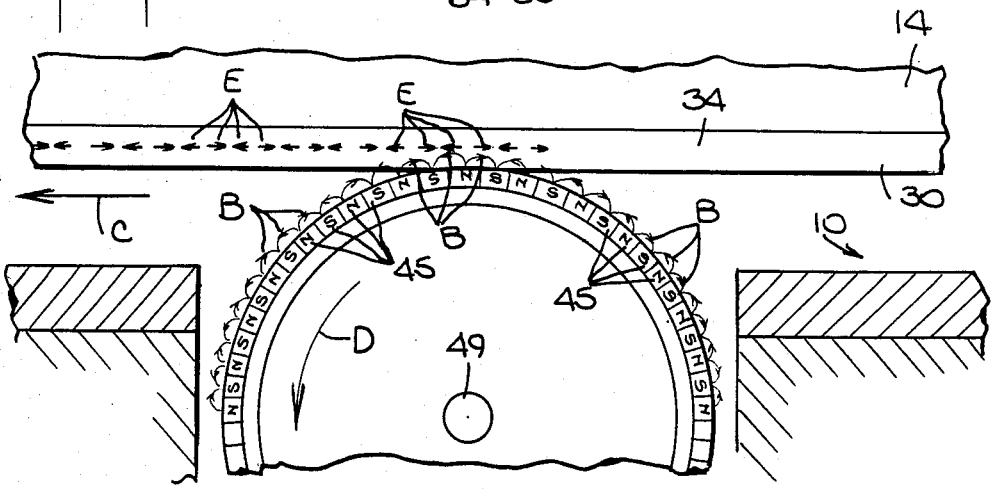

METHOD AND APPARATUS FOR DEACTIVATING TARGETS USED IN ELECTROMAGNETIC TYPE ARTICLE SURVEILLANCE SYSTEMS

BACKGROUND OF THE INVENTION

1. Field of the Invention

This invention relates to article surveillance systems and more particularly it concerns novel methods and apparatus for deactivating targets used in such systems.

2. Description of the Prior Art

Magnetic type surveillance systems for protecting articles from theft are shown and described in French Pat. No. 763,687 and in U.S. Pat. Nos. 4,118,693, 4,326,198 and 4,384,281. As described in those patents, targets which are affixed to protected articles are made up of thin elongated strips of highly permeable, easily saturable magnetic material such as permalloy. Also, as described in U.S. Pat. Nos. 3,747,086, 3,820,103 and 3,820,104, the targets can be made deactivatable by providing them with deactivation elements of a high coercivity, magnetically hard material, such as vicalloy, which can be magnetized to provide spaced apart north and south magnetic poles which are effective to break up the magnetic continuity of the target strips. The deactivation elements are magnetized and demagnetized by subjecting them to a powerful magnetic field generated by a deactivating and reactivating machine at a checkout or authorizing station.

Pending U.S. patent application Ser. No. 513,242 filed July 13, 1983 discloses a deactivatable target which comprises a long continuous strip of permalloy material and a colinear continuous deactivation strip extending along the length of the permalloy strip. The deactivation strip is of a magnetically hard material such as vicalloy which is capable of being magnetized according to various patterns along its length. U.S. application Ser. No. 513,242 also discloses a permanent magnet deactivation assembly comprising a magnetizing strip or sheet having permanent magnets arranged therein with spaced apart alternate magnetic poles. When the target with its deactivation strip is placed along the deactivation assembly, the magnets therein cause the target's deactivation strip to become magnetized according to the pattern of the spaced apart alternate magnetic poles; and, as a result, the target's deactivation strip prevents the target from responding to an interrogation field when an article with the target attached to it is carried through the field.

The apparatus shown in U.S. patent application Ser. No. 513,242 also includes various arrangements for maintaining the target essentially parallel to the magnetizing strip or sheet and for guiding the target so that it is moved away from the magnetizing strip or sheet in a direction generally perpendicular thereto in order to maintain the pattern of magnetization imposed upon the target's deactivation strip by the deactivation assembly.

U.S. Pat. No. 4,568,921 shows an alternate form of target wherein the target strip comprises a wire of soft magnetic material such as permalloy and wherein the deactivation strip comprises one or more wires of hard magnetic material such as vicalloy.

SUMMARY OF THE INVENTION

The present invention makes it possible to deactivate targets in a simple and economical, yet reliable, manner.

According to one aspect of the invention there is provided novel apparatus for deactivating an electromagnetic article surveillance system target of the type comprising an elongated strip of magnetically soft, easily saturable magnetic material and an adjacent elongated strip of high coercivity, magnetically hard material. This apparatus comprises a solid element having a convexly curved outer surface and incorporating therein a plurality of permanent magnets arranged to produce, in a plane adjacent the surface, a pattern of variously directed magnetic fields such that along at least one given line in that plane, the magnetic fields are discontinuous. The curved outer surface of the solid element is rollable along another surface and over a target affixed to the other surface. In the preferred embodiments the solid element is in the form of a freely rotatable cylinder which is mounted so that a surface containing the target to be deactivated can roll over the cylinder or so that the cylinder can be rolled over the surface containing the target.

According to another aspect of the invention there is provided a method for deactivating an electromagnetic article surveillance system target of the type described above. This method is carried out by first positioning, on a surface which contains a target, a solid element having a convexly curved outer surface. The solid element incorporates therein a plurality of permanent magnets arranged to produce in a plane adjacent the curved surface, a pattern of variously directed magnetic fields such that along at least one given line in that plane, the magnetic fields are discontinuous. The solid element is then rolled on its convexly curved surface over the surface containing the target and the target itself so that the curved surface of the element comes into contact with and thereafter moves away from the target. As a result the magnetic fields produced by the permanent magnets of the solid element are imposed on the target and then moved away from the target in a direction generally perpendicular to the plane of the target.

The present invention, in another aspect, provides a novel target deactivation apparatus which produces a magnetic field pattern characterized by differently directed magnetic fields along every direction in a plane adjacent the apparatus. This permits the target to be deactivated irrespective of the direction it is extending during deactivation.

According to a preferred arrangement of this last mentioned aspect of the invention there are provided first and second groups of mutually adjacent elongated permanent magnets arranged alongside each other and the groups lying, respectively, in first and second adjacent parallel planes. The magnets of each group are magnetized transversely to their length and are arranged with their magnetic poles extending along elongated surfaces thereof to produce a plurality of mutually adjacent alternately directed magnetic fields in the vicinity of their respective planes. The elongated magnets of the first group extend in a different direction than the elongated magnets of the second group. As a result the magnetic fields of both groups of magnets combine to form, in a third plane adjacent and parallel to the first and second planes, a composite magnetic field pattern characterized by alternately directed magnetic fields along every direction in the third plane. Thus target deactivation is assured no matter what direction the target is facing when it is subjected to the composite magnetic field.

The invention in its more specific aspects is described hereinafter in the specification.

BRIEF DESCRIPTION OF THE DRAWINGS

FIG. 3 is an enlarged fragmentary perspective view showing the target deactivator of FIG. 1.

FIG. 5 is an enlarged fragmentary view taken along line 5—5 of FIG. 4 and showing diagrammatically the manner in which magnetic field patterns are maintained according to this invention.

FIG. 6 is a perspective view showing the development of construction of the target deactivator of FIG. 3.

FIG. 8 is a schematic of a magnetic field pattern produced by the deactivator construction of FIG. 6.

DETAILED DESCRIPTION OF THE PREFERRED EMBODIMENTS

Figure 1:
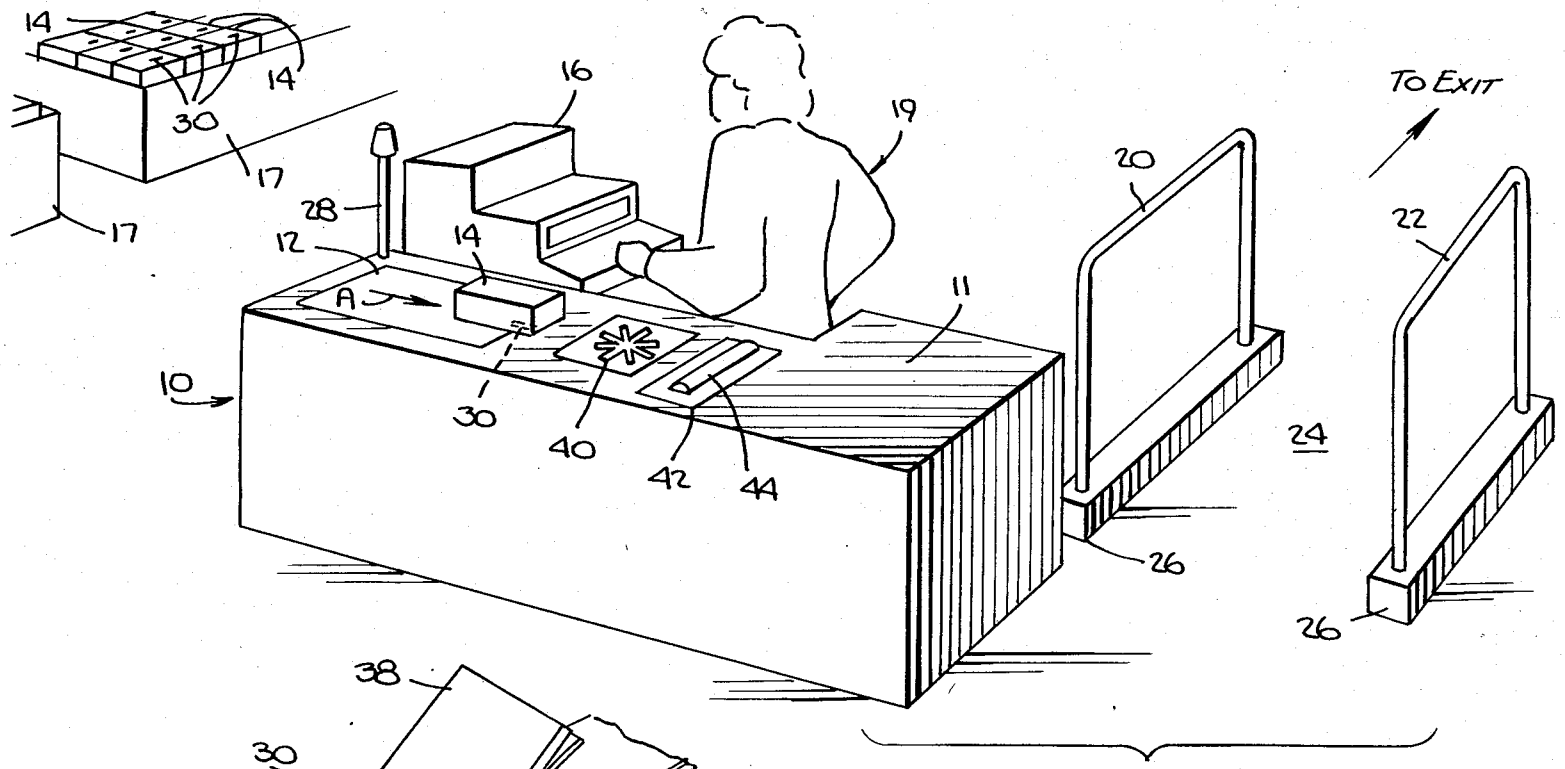
FIG. 1 shows a target deactivator forming one embodiment of this invention and incorporated into a supermarket checkout counter.

In FIG. 1 there is shown a supermarket checkout counter 10 having a conveyor belt 12 which carries merchandise, such as items 14 to be purchased, in the direction indicated by an arrow A, past a cash register 16 positioned alongside of the counter. A patron (not shown) who has selected goods from various shelves or bins 17 in the supermarket, places them on the conveyor belt 12 at one end of the counter 10. A clerk 19 standing at the cash register 16 records the price of each item of merchandise as it moves past on the conveyor belt. The items are then paid for and are bagged at a bagging area 11 at the other end of the counter.

The theft detection system with which this invention is used includes a pair of spaced apart antenna panels 20 and 22 located beyond the counter 10 along a pathway leading to the store exit. The antenna panels 20 and 22 are spaced far enough apart to permit store patrons to pass between them as the store patrons leave the supermarket with the merchandise they have purchased.

The antenna panels 20 and 22 contain transmitter antennas which generate an alternating magnetic interrogation field in an interrogation zone 24 between the panels. The antenna panels 20 and 22 also contain receiver antennas which produce electrical signals corresponding to variations in the magnetic interrogation field in the zone 24. The antennas are electrically connected to transmitter and receiver circuits contained in housings 26 located at the bottom of the panels 20 and 22. There is also provided an alarm, such as a light 28, mounted on the counter 10, which can easily be seen by the clerk and which is activated by the electrical circuit when a protected item 14 is carried between the antenna panels 20 and 22. If desired, an audible alarm may be provided instead of, or in addition to, the light 28.

Those of the items 14 which are to be protected against shoplifting are each provided with a target 30 which comprises a thin elongated strip or wire of high permeability easily saturable material such as permalloy. The targets 30 are attached to the items 14 in a manner such that they are concealed thereon or such that they cannot readily be removed. When an item having an attached target 30 is carried through the interrogation zone 24, the alternating magnetic interrogation field in the zone drives the target 30 alternately into and out of magnetic saturation. This causes disturbances of the alternating magnetic interrogation field in the form of other alternating magnetic fields whose frequencies are harmonics of the interrogation field. The receiver circuits detect these other fields and produce an alarm in response thereto. The construction of the transmitter and receiver circuits is not part of this invention and will not be described in detail herein. However, such circuits may be as described in U.S. Pat. No. 4,384,281 or in U.S. patent application Ser. No. 509,292 filed June 29, 1983.

Figure 2:
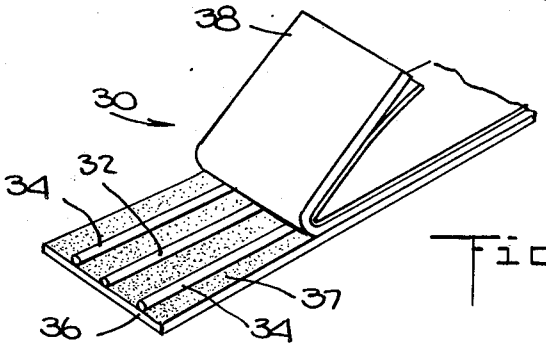
FIG. 2 is an enlarged perspective view showing a target to be deactivated by the deactivator of FIG. 1.

FIG. 2 shows the construction of the targets 30. As shown, the targets comprise a long thin magnetically saturable strip or wire 32 positioned adjacent to similarly shaped deactivation strips 34 of high coercivity material. The deactivation strips 34, when subjected to a magnetic field, become magnetized in accordance with the field and retain that magnetization until they are thereafter subjected to a different magnetic field. Moreover, when the strips 34 are subjected to a pattern of variously directed magnetic fields e.g., a series of oppositely directed fields along the length of the strips 34, they become magnetized accordingly and subject the saturable strip 32 to that same magnetic pattern. As a result, the saturable strip 32 becomes incapable of responding to the alternating magnetic interrogation field in the interrogation zone 24 and cannot produce detectable disturbances of the interrogation field. In other words, when the high coercivity strips 34 are magnetized according to a pattern of oppositely directed magnetic fields along their length they effectively deactivate the target 30.

As also shown in FIG. 2, the target 30 may comprise a paper label 36 which covers and supports the strips 32 and 34 and which contains printed information such as an inventory control bar code. The strips 32 and 34 are held to the label 36 by adhesive 37 which also fastens the label to the items of merchandise 14. FIG. 2 shows a peel 38 which can be peeled away to allow the label 36 with the magnetic strips 32 and 34 to be adhered to the merchandise 14.

Reverting now to FIG. 1 it will be seen that there is provided on the counter 10 just beyond the conveyor belt 12 a bar code reader 40. These devices are well known and are used to automatically record the sale of articles of merchandise when they are passed over the reader in a manner such that the bar code on the article can be seen by the reader.

Just beyond the bar code reader 40 on the counter 10 there is provided a target deactivator 42. The target deactivator 42 includes a free rolling cylinder 44 which projects slightly above the surface of the counter 10. Thus when the clerk moves an article 14 over the bar code reader 40, the clerk continues to move the article over the target deactivator 42. As will be appreciated, the target 30 which is incorporated with the label 36 containing the bar code to be read by the reader 40, is located on the bottom of the article 14 as it is passed over the reader 40. Thus, continued movement of the article 14 causes the target 30 to contact the free rolling cylinder 44 of the deactivator 42 and to roll over the cylinder. As will be explained more fully hereinbelow, this rolling movement of the cylinder 44 along the target 30 causes the target to become deactivated so that the article 14 to which it is attached can be carried through the interrogation zone 24 without producing an alarm.

Figure 4:
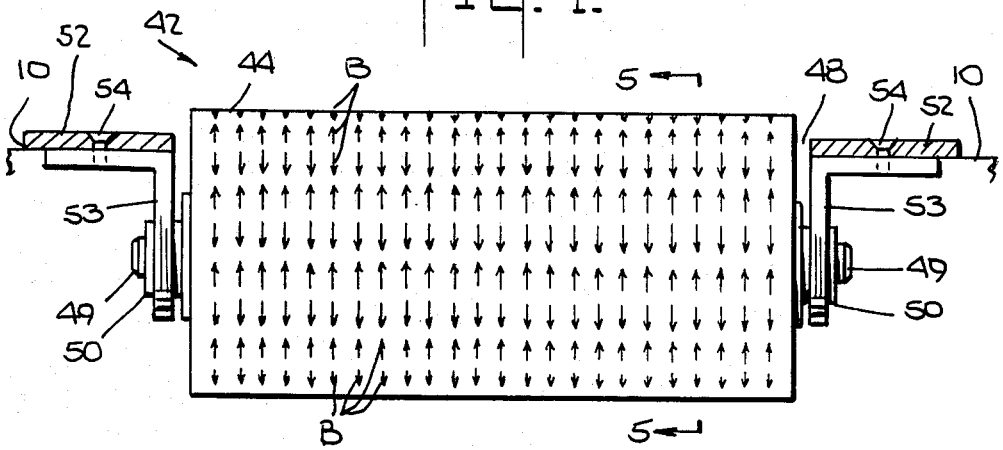
FIG. 4 is a section view taken along line 4—4 of FIG. 3.

As shown in FIG. 3, the deactivator cylinder 44 is inset into a recess 48 in a frame 52 which is fitted to the counter 10. Also, as shown in FIG. 4, the cylinder 44 of the target deactivator 42 is provided with a stub axle 49 at each of its opposite ends. The axles 49 are mounted for free rolling in bearings 50 which in turn are supported by flange brackets 53. The flange brackets 53 are held to the underside of the frame 52 at each end of the recess 48 by means of rivets 54. As shown in FIG. 3, the frame 52 itself is held to the counter 10 by means of rivets 56.

As can be seen in FIG. 4, the cylinder 44 is mostly under surface of the the counter 10, although its circumference projects slightly up above the surface of the counter. With this arrangement, articles of merchandise that are passed over the bar code reader 40 are then moved over the target deactivator 42 causing the cylinder 44 to rotate and roll along the surface of the merchandise. The deactivation targets may be incorporated into the bar code labels so that the same action of passing the articles over the bar code reader to record their purchase also involves rolling them over the deactivator cylinder 44 to deactivate their targets 30 so that they can be carried through the interrogation zone 24 of the exit passageway without causing the alarm to sound.

The deactivator cylinder 44 is formed with a plurality of permanent magnets 45 arranged with their poles near the surface of the cylinder so as to produce, in a plane adjacent to the cylinder surface, a pattern of oppositely directed magnetic fields. These fields are represented in FIGS. 4 and 5 by arrows B. As an article 14 is moved over the deactivator 42, as represented by an arrow C in FIG. 5, the target 30 on the article contacts the deactivator cylinder 44 causing it to turn in the same direction as represented by an arrow D. This rolling action causes different regions of the high coercivity strips 34 of the target 30 to come into and then to leave successive oppositely directed magnetic fields B. These fields impart a permanent magnetism to the high coercivity strips 34 as represented by arrows E in FIG. 5. These fields are also mutually oppositely directed according to the patterns of the fields B adjacent to the surface of the cylinder 44. That is, these fields are discontinuous along the line of the arrow C and the line of the arrow D. This magnetization of the high coercivity strips 34 causes them to deactivate the target 30 as explained above so that the article 14 can be carried through the interrogation zone 24 without producing an alarm.

The targets 30 can be reactivated by drawing a permanent magnet along the length of the high coercivity strips 34 to reorient their magnetic fields and produce a continuous magnetization in a single direction or no magnetization at all.

The deactivation cylinder 44, in rolling along the surface of the target 30 as shown in FIG. 5, undergoes no sliding action relative to the target. Instead, each region on the cylinder surface successively comes into contact with and then moves back away from a corresponding region of the target. Although this movement is not precisely perpendicular to the plane of the target and the plane of the cylinder surface, it is nearly perpendicular, at least in the region where the magnetic fields from the cylinder 44 interact with the high coercivity strips 34. Consequently there is almost no smearing or distortion of the magnetic field pattern produced in the strips 34 as the strips move away from the cylinder 44.

Figure 7:
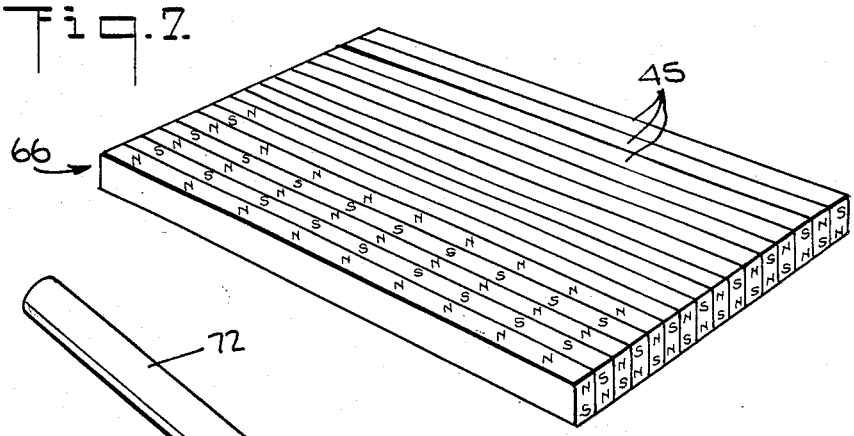
FIG. 7 is an enlarged diagrammatic perspective view showing one of the permanent magnet layers used in the construction of the target deactivator of FIG. 3.

FIGS. 6–8 show in greater detail the construction of the deactivator cylinder 44. As shown in FIG. 6, the cylinder 44 comprises a cylindrical core 62 of any solid non-magnetic material, such as wood or plastic, and two layers 64 and 66 of magnetic sheeting wrapped around the circumference of the cylinder. Each layer of magnetic sheeting is formed as a series of elongated permanent magnets 45 polarized in a direction transverse to their length and arranged so that alternate poles lay side by side along the surface of each layer as can be seen in FIG. 7. An example of such magnetic sheeting is Plastiform® brand magnetic sheeting sold by Industrial Electrical Products Division 225-4S 3M Center, St. Paul, Minn. 55144. As will be appreciated, the alternate arrangement of elongated poles results in a pattern of oppositely directed magnetic fields in a plane adjacent the plane of the magnetic layer. When a magnetizable element or strip 34 is positioned such plane and becomes subjected to those magnetic fields it also becomes magnetized according to the pattern of the magnetic fields; and if the magnetizable element is of a high coercivity magnetically hard material it will, after being removed from the plane in a direction substantially perpendicular thereto, retain that pattern of magnetization. When such magnetizable element is a deactivation element lying adjacent a target strip of readily permeable material, such as permalloy, the magnetizable element when so magnetized will deactivate the strip.

The targets 30 are from four inches (10.2 cm.) to seven inches (17.8 cm.) in length. In order to form a discontinuous magnetic pattern to deactivate the targets the magnetic poles should be closely enough spaced from each other to produce several discontinuities in polarity along with length of the target. Magnetic sheeting having alternate poles spaced apart by about 0.09 inches (2.29 mm.) has been found to operate satisfactorily.

If the elongated magnetizable elements or strips 34 were oriented so that they extend in the same direction as the magnets on the cylinder 44, the elements or strips 34 would not extend across several poles and would not therefore become exposed to a plurality of oppositely directed magnetic fields. It will be appreciated therefore, that in order to deactivate a target it is necessary that the target be positioned so that it extends crossways to the magnets on the cylinder 44.

The dual layer magnetic sheeting arrangement shown in FIG. 6 makes it possible to ensure that the target deactivation strips 34 will become magnetized according to a series of oppositely directed magnetic fields irrespective of the direction in which the target extends when it contacts the deactivator cylinder 44. As can be seen in FIG. 6, the poles of the inner layer 64 extend in a direction circumferentially of the cylinder which the poles of the outer layer 66 extend in a direction axially of the cylinder. The two layers cooperate to form a composite magnetic field pattern in a plane adjacent the outer layer 66 such as shown in FIG. 8. As can be seen, this composite pattern is diamond shaped so that irrespective of whatever direction a target deactivation strip may extend when it is placed in the magnetic field, it will become subjected to a pattern of alternately directed magnetic fields and will be magnetized according to such pattern.

While the diameter of the cylinder 44 is not critical it should be large enough so that the targets over which it rolls will become subjected to several alternately directed fields. Also, the diameter should be large enough so that each location on the cylinder will move away from the target in a direction essentially perpendicular to the plane of the target. A preferred diameter for the cylinder 44 is about two inches (5.1 cm). The cylinder length should be great enough to accommodate the article 14 being moved over the deactivator. A cylinder length of about ten inches (25.4 cm) is preferred for supermarket application.

In order to produce a diamond shaped magnetic pattern such as shown in FIG. 8, the magnets of the inner layer 64 of magnetic sheeting should be stronger than those of the outer layer 66; and accordingly, the inner layer 64 is thicker than the outer layer 66. This enables the magnetic field produced by the inner layer to pass through the outer layer and combine with the field produced by the outer layer in a plane adjacent the outer layer. It has been found that when the magnetic sheeting is Plastiform brand magnetic sheeting, MGO 1016, the inner layer 64 should have a thickness of 0.60 inches (0.152 cm) and the outer layer should have a thickness of about 0.30 inches (0.076 cm). The layers may be held to the core 62 by means of adhesive or by double sided adhesive tape.

Figure 9:
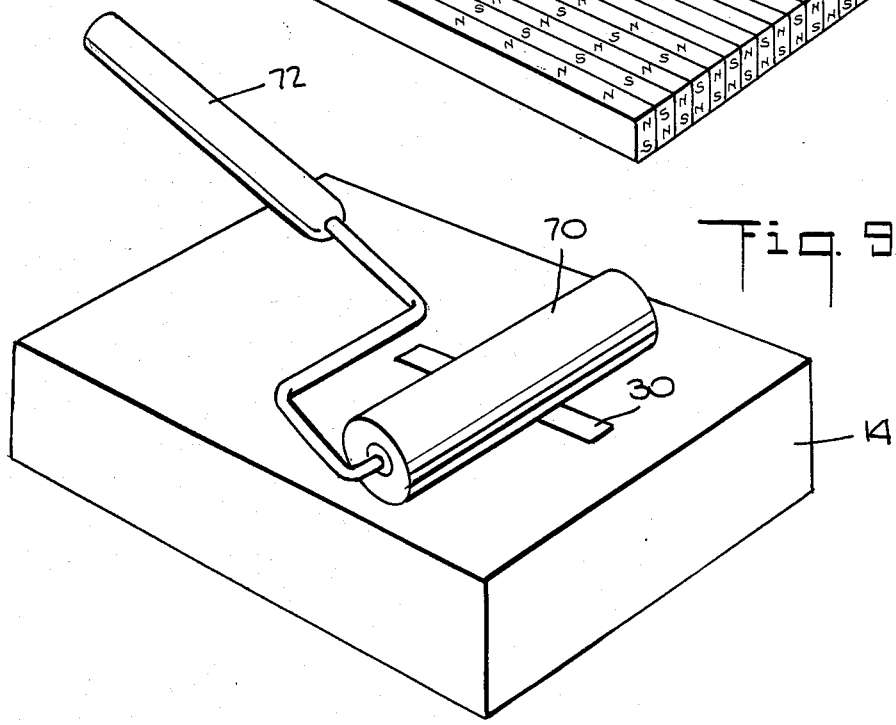
FIG. 9 is a perspective view of an alternate embodiment of the deactivator of FIG. 3.

FIG. 9 shows an alternate embodiment of the present invention wherein a cylindrical roller 70 of essentially the same construction as the roller 44 of the preceding embodiment is mounted on a handle 72 similar to the handle of a paint roller. In this embodiment the target 30 is deactivated by placing the roller 70 on the article 14 and rolling it over the target 30.

It will be appreciated that the deactivator of the present invention provides reliable deactivation by maintaining the magnetic poles and corresponding fields so that they move away from the target in a direction nearly perpendicular to the plane of the target and therefore do not produce any smearing of the pattern of alternatively directed fields. The deactivation of the invention moreover is of simple and economical construction and is simple and convenient to use.

We claim:

1. Apparatus for deactivating an electromagnetic article surveillance system target of the type comprising an elongated strip of magnetically soft, easily saturable magnetic material and an adjacent elongated strip of high coercivity, magnetically hard material, said apparatus comprising a solid element having a convexly curved outer surface and incorporating therein a plurality of permanent magnets arranged to produce in a plane adjacent said surface a pattern of variously directed magnetic fields such that along at least one given line in that plane, the magnetic fields are discontinuous, said curved outer surface of said solid element being rollable along a second surface and over a target affixed to said second surface.

2. Apparatus according to claim 1 wherein said solid element is a cylinder.

3. Apparatus according to claim 2 wherein said cylinder is mounted on a support to be freely rotatable thereon.

4. Apparatus according to claim 3 wherein said support comprises a handle with a hand grip.

5. Apparatus according to claim 3 wherein said support comprises a counter top having flat upper surface and a recess formed therein and brackets attached to the countertop and supporting said cylinder for free rotation in said recess.

6. Apparatus according to claim 5 wherein said brackets are arranged such that the axis of rotation of said cylinder is below the upper surface of the counter top and the surface of said cylinder extends up through said recess.

7. Apparatus according to claim 1 wherein said plurality of permanent magnets includes adjacent elongated magnets arranged to form parallel lines of alternate north and south poles along said curved surface.

8. Apparatus according to claim 1 wherein said plurality of magnets comprises first and second adjacent layers of adjacent elongated permanent magnets polarized transversely to their length, and forming parallel lines of alternate north and south poles, the magnets of one layer extending in a different direction than the magnets of the other layer.

9. Apparatus according to claim 8 wherein the magnets of one layer extend transversely to the magnets of the other layer.

10. Apparatus according to claim 8 wherein the magnets of the layer farthest from said convexly curved outer surface are more strongly magnetized than the magnets of the other layer.

11. A method for deactivating an electromagnetic article surveillance system target of the type comprising an elongated strip of magnetically soft, easily saturable magnetic material and an adjacent elongated strip of high coercivity, magnetically hard material, said method comprising the steps of positioning, on a surface which contains a target, a solid element having a convexly curved outer surface and incorporating therein a plurality of permanent magnets arranged to produce, in a plane adjacent said curved outer surface, a pattern of variously directed magnetic fields such that along at least one given line in that plane the magnetic fields are discontinuous, and rolling said element along its said convexly curved outer surface and over the first mentioned surface in a manner such that said curved surface comes into contract with and thereafter moves away from said target.

12. A method according to claims 11 wherein said solid element is a cylinder mounted for free axial rotation about a support and wherein said rolling is carried out by placing said cylinder on the surface which contains the target and then moving the support in a direction parallel to the surface and perpendicular to the axis of said cylinder to cause said cylinder to roll along said surface and over said target.

13. A method according to claim 11 wherein said solid element is a cylinder mounted for free axial rotation about a support and wherein said rolling is carried to by maintaining said support in a fixed position, placing said surface which contains the target against the surface of the cylinder and moving said surface which contains the target in a direction perpendicular to the axis of the cylinder while holding the surface which contains the target against the surface of the cylinder to cause the cylinder to turn and roll along the surface which contains the target and over the target.

14. A target deactivator for deactivating an electromagnetic article surveillance system target used of the type comprising a thin elongated strip of magnetically soft, easily saturated magnetic material and an adjacent elongated strip of high coercivity, magnetically hard low material, said target deactivator comprising a plurality of permanent magnets arranged so as to form in a continuous plane a pattern of magnetic fields which are discontinuous in every direction along said plane.

15. Apparatus according to claim 14 wherein said permanent magnets comprise two groups of elongated magnets magnetized transversely to their length and arranged alongside each other to form parallel lines of alternate polarity, the magnets of each group forming a layer and the layers formed of the two groups being adjacent to each other and adjacent to said continuous plane, the magnets in one group extending in a different direction than the magnets in the other group.

16. Apparatus according to claim 15 wherein the magnets of the group farthest from said continuous plane are magnetized more strongly than the magnets of the other group.

* * * * *

UNITED STATES PATENT AND TRADEMARK OFFICE

CERTIFICATE OF CORRECTION

PATENT NO. : 4,684,930

DATED : August 4, 1987

INVENTOR(S) : ARTHUR J. MINASY, ET AL.

It is certified that error appears in the above-identified patent and that said Letters Patent is hereby corrected as shown below:

AT [57] IN THE ABSTRACT

Line 5, "patter" should read --pattern--.
Line 5, "is" should read --in--.

COLUMN 1

Line 15, "763,687" should read --763,681--.
Line 24, "spaced apart" should read --spaced-apart--.
Line 43, "spaced apart" should read --spaced-apart--.
Line 47, "spaced apart" should read --spaced-apart--.

COLUMN 2

Line 48, "last" should read --last- --.

COLUMN 3

Line 43, "spaced apart" should read --spaced-apart--.

COLUMN 6

Line 20, "positioned such" should read --positioned in such--.
Line 56, "of" should read --to--.
Line 56, "which" should read --while--.
Line 58, "of" should read --to--.

COLUMN 7

Line 11, "diamond shaped" should read --diamond-shaped--.
Line 25, "double sided" should read --double-sided--.
Line 39, "deactivation" should read --deactivator--.

UNITED STATES PATENT AND TRADEMARK OFFICE

CERTIFICATE OF CORRECTION

PATENT NO. : 4,684,930

DATED : August 4, 1987

INVENTOR(S) : ARTHUR J. MINASY, ET AL.

It is certified that error appears in the above-identified patent and that said Letters Patent is hereby corrected as shown below:

COLUMN 7

Line 67, "countertop" should read --counter top--.

COLUMN 8

Line 41, "claims" should read --claim--.
Line 61, "used" should be deleted.
Line 65, "low" should be deleted.

COLUMN 9

Line 1, "Apparatus" should read --A target deactivator--.

COLUMN 10

Line 3, "Apparatus" should read --A target deactivator--.

Signed and Sealed this

Fifth Day of January, 1988

*Attest:*

DONALD J. QUIGG

*Attesting Officer*

*Commissioner of Patents and Trademarks*